United States Patent [19]

Walker et al.

[11] 4,420,278

[45] Dec. 13, 1983

[54] HEADING SHIELD

[75] Inventors: Andrew J. Walker, Tewkesbury, England; John C. Watt, Johannesburg, South Africa

[73] Assignee: Dowty (South Africa) (Proprietary) Limited, South Africa

[21] Appl. No.: 234,745

[22] Filed: Feb. 17, 1981

[30] Foreign Application Priority Data

Feb. 29, 1980 [ZA] South Africa ..... 80/1171
Aug. 8, 1980 [ZA] South Africa ..... 80/4838

[51] Int. Cl.[3] ..... E21D 23/00; E21C 29/00
[52] U.S. Cl. ..... 405/301; 299/31
[58] Field of Search ..... 405/141, 145, 291, 293, 405/299-301; 299/18, 31, 33

[56] References Cited

U.S. PATENT DOCUMENTS 2,753,036 7/1956 Joy ..... 299/33
3,333,424 8/1967 Keil ..... 405/300
4,131,317 12/1978 Jamison et al. ..... 299/31
4,189,258 2/1980 Maykemper et al. ..... 405/291
4,192,632 3/1980 Von Viebahn et al. ..... 405/298

*Primary Examiner*—David H. Corbin
*Assistant Examiner*—Nancy J. Pistel
*Attorney, Agent, or Firm*—Scully, Scott, Murphy & Presser

[57] ABSTRACT

The roof of a heading cut by a continuous mining machine is supported by cantilevered roof beams forming part of a shield. There are at least two sets of roof beams which can be raised and lowered separately by means of hydraulic rams. When one set is lowered and the other set is raised, the lowered set can be pushed forward against the raised set by means of hydraulic rams. The cantilevered roof beams extend far enough forward to support the roof over the driving position of the continuous mining machine. The width of the shield should be less than the width of the mining machine, so that the shield can advance along the heading cut by the mining machine. Furthermore, the shield includes a conveyor for conveying the mined material from the mining machine backwards to a shuttle car or other conveying system.

12 Claims, 10 Drawing Figures

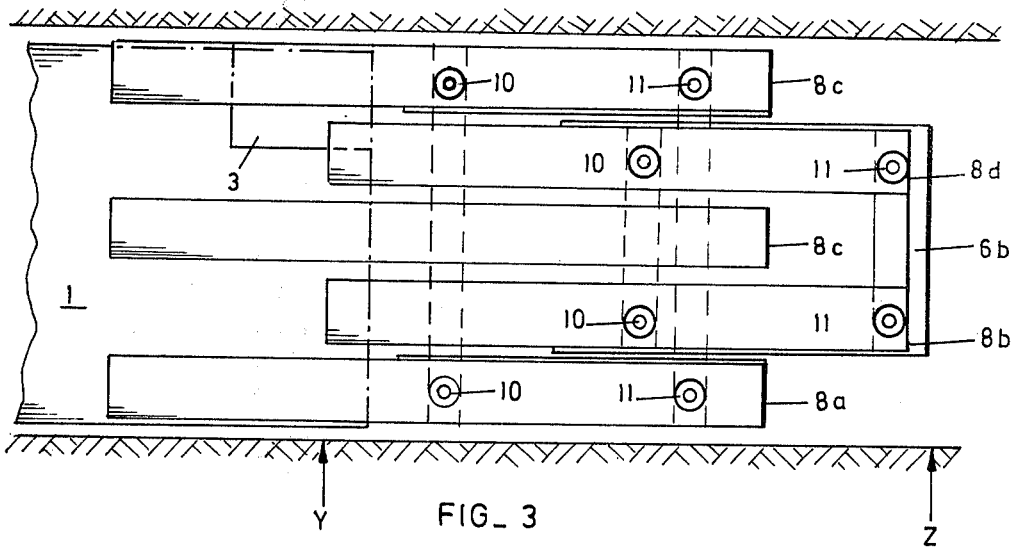
FIG_ 3
FIG _ 4
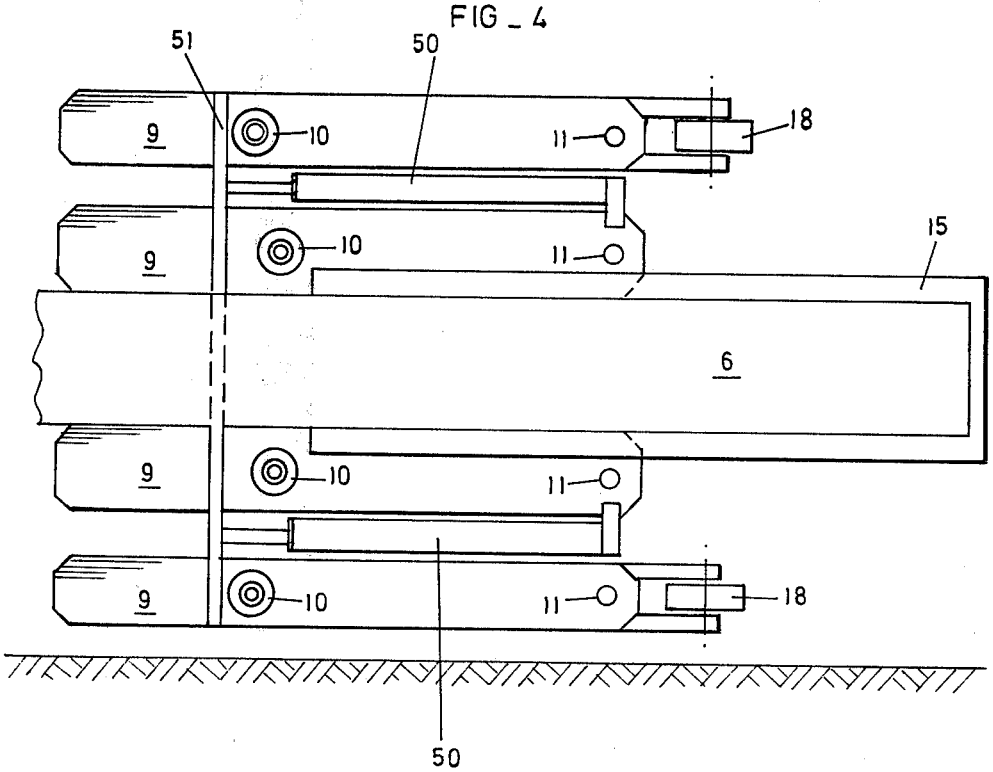

HEADING SHIELD

FIELD OF THE INVENTION

THIS invention relates to a heading shield of providing temporary roof support over and behind a continuous mining machine as the machine advances along a heading, prior to the installation of permanent roof support.

BACKGROUND TO THE INVENTION

In theory, continuous mining machines can continue to operate over long stretches without a break. The length of heading which can be cut in one continuous operation is, in theory, determined by the problems of getting ventilation to the face. There is however a second problem. It is unsafe for the driver of the machine to venture into an area of the heading where the roof is unsupported. In many coal mines, permanent roof support is installed by roofing bolting. Installation of roof bolts takes a certain amount of time and, more importantly, can only be carried out where access to the roof can be obtained perpendicularly or substantially perpendicularly below the spot where the bolt is to be installed.

One technique which is currently used is to first install permanent roof support right up to the face, then for the continuous mining machine to mine the face until the driver of the machine is just about to proceed beyond the supported roof. The machine is then withdrawn and cuts in an adjacent heading whilst the newly exposed roof is permanently supported using roof bolts. This is an extremely slow operation and fails to make use of the potentialities of a continuous mining machine.

It has been proposed to use a full heading shield to overcome this problem. The full heading shield is a structure which straddles the continuous mining machine and which can "walk" along the heading as the machine advances. The shield provides temporary roof support over the machine, and roof bolting can be carried on continuously in the area uncovered by the temporary roof support behind the mining machine. A disadvantage with this technique is that the heading shield needs a heading width greater than the width of the mining machine in which to operate. The mining machine therefore has to move forwards to cut one advance, then back and sideways and forwards again to cut another advance to widen the heading before the heading shield can advance. The mining machine therefore spends a substantial time in moving to and fro from one face to another, rather than continuously mining.

SUMMARY OF THE INVENTION

According to the present invention, there is provided a heading shield for supporting a mine roof above and behind a continuous mining machine, the shield comprising two parallel canopy units, each unit including roof beams and retractable support means for supporting the roof beams against a mine floor, the roof beams extending beyond the base of the support means in a lengthwise direction of the shield so that, in use, the support means can be positioned behind a continuous mining machine while the roof beams extend above the machine to support the roof at least above driver's position on the machine, the canopy units being connected to each other by means which can be actuated to move one unit relative to the other, and a conveyor for mined material extending through the shield in a lengthwise direction.

The conveyor will normally discharge to a shuttle car, and the shield may include a bunker associated with the conveyor for receiving mined material while the shuttle car is absent from the discharge end of the conveyor.

At least some of the roof beams may be hollow and adapted to be connected to ventilation ducting at their rear ends, so that the roof beams form a forward extension of the ventilation ducts.

The shield preferably includes wheels on which it can be rapidly drawn out of the heading when necessary.

The roof beams on one canopy unit are preferably arranged between roof beams of another canopy unit.

The invention also provides a method of supporting a mine roof behind a continuous mining machine, wherein a shield which has two parallel canopy units is positioned in a heading behind the machine with roof beams forming parts of the canopy units extending forward over at least part of the machine and supporting the mine roof, and wherein as the machine advances, one of the canopy units is retracted from its roof-supporting condition and advanced whilst the second unit remains stationary in a roof-supporting condition, the first unit is brought into a roof-supporting condition at its advanced position, the second unit is retracted from its roof supporting condition and advanced up to the first unit where it is again brought into a roof-supporting condition, and this cycle is repeated in such a way that roof beams on one of the canopy units are always in a roof-supporting condition above the driver's position on the continuous mining machine.

This method makes it possible to provide continuous support over and behind the mining machine as the machine advances, without in any way obstructing the machine or preventing it travelling continuously forwards. The length of heading which can be cut is in theory unlimited, but in practice is determined by the problems of ventilation. Roof bolting can continue behind the heading shield as the shield advances, and can even take place between the roof beams of the shield, in areas where the shield is supporting the roof.

BRIEF DESCRIPTION OF THE DRAWINGS

The invention will now be further described, by way of example, with reference to the accompanying drawings, in which:

FIG. 3 is a schematic plan view of the shield shown in the previous figures;

FIG. 4 is a horizontal section through the shield on the line IV-IV.

DETAILED DESCRIPTION OF A PREFERRED EMBODIMENT

Figure 1:
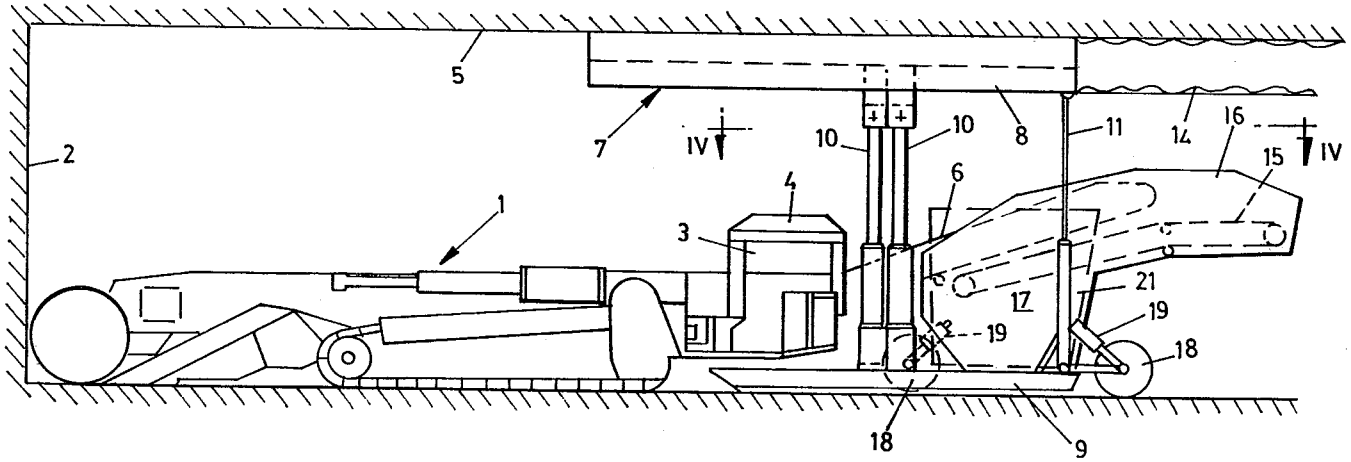
FIG. 1 is a side view of a continuous mining machine and a heading shield according to the invention in a heading.

FIG. 1 shows a continuous mining machine 1 positioned in a heading and ready to mine material at a face 2. The mining machine has a driving position 3 protected by a cab 4. Operation of the mining machine produces a heading with a roof 5. The material mined by the machine is passed backward along the machine to a conveyor boom 6 which can pivot about a horizontal axis relative to the machine. Mined material is carried rearwards on the upper surface of this boom 6.

Behind the machine 1 is a heading shield generally designated 7. The shield has a number of roof beams 8 supported on base pontoons 9 by means of main hydraulic rams 10. It will be seen that the main rams 10 are positioned towards the centres of the beams 8 and that stabilizing rams 11 are mounted at the rear end. The forward ends of the beams 8 extend forward from the rams 10 a substantial distance, and well beyond the drivers position 3. In practice, it has been found convenient if the beams 8 extend 1,5 meters in front of the driving position. This is the distance the continuous miner will travel at full speed in 6 minutes, 6 minutes being the maximum time taken to instal a roof bolt behind the shield.

Figure 2:
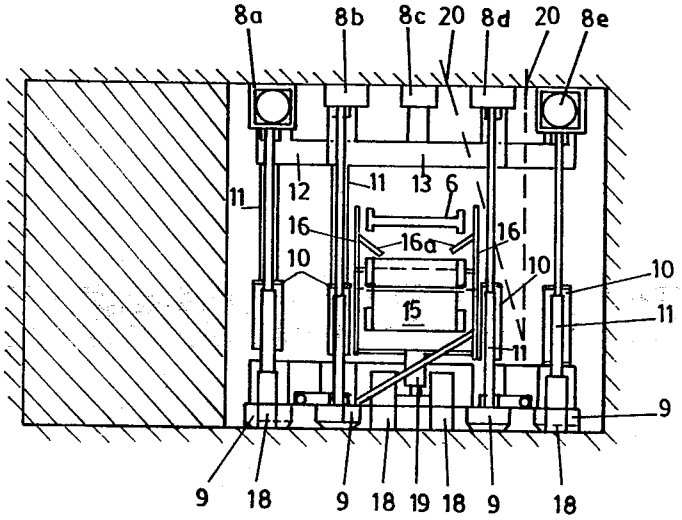
FIG. 2 is a rear view of the heading shield shown in FIG. 1.

As can be seen in FIG. 2, five roof beams are employed. The beams 8*a* 8*c* and 8*e* together form a first canopy unit and are interconnected by a cross beam 12. The beams 8*b* and 8*d* form a second canopy unit and are interconnected by a cross beam 13. Hydraulic rams 50 are connected between portions 9 of the second canopy unit and cross-bar 51 of the first canopy unit so that they can push the units apart or pull them together along the length of the heading. The outer roof beams 8*a* and 8*e* are of a hollow section, and are connected at their rear ends to ventilation ducting 14, and so form an extension of that ducting. As the shield advances, the ducting will be pulled with it so as to bring the ventilation close to the face 2. The ducting 14 will be suspended from the roof in a conventional manner.

The shield 7 has a conveyor 15 mounted between side panels 16 and discharging rearwardly. The side panels include guide plates 16*a* for mined material. The boom 6 discharges between the side panels 16 on to the conveyor 5, and the discharged material is then conveyed further to the extreme righthand end of the conveyor 15 and from there on to a shuttle car or further conveyor which extends under the conveyor 15.

As the mining machine 1 moves forward relative to the shield 7, the righthand end of the boom 6 moves towards the front end of the conveyor 15. However the amount of overlap of the conveyors 6 and 15 is such that they will always overlap even when the mining machine is in its furthest forward position relative to the shield. Although not shown in this drawing, a bunkering facility could be provided in the area 17 to accept mined material when a shuttle car has left the end of the conveyor 15 to be emptied. Such a system would involve the conveyor 15, when operating, running at a faster speed than the conveyor 6 to clear the bunkered material when the shuttle car is present.

The shield also has forward and rear wheels 18. Rams 19 are associated with these wheels and can be activated to extend the wheels downwardly so that the shield is supported on these wheels, and can be towed out of the heading, for example by the shuttle car. It may alternatively be possible to provide a motor on the shield for moving the shield on its wheels.

In operation, the rams 10 are extended so that the pontoon bases 9 are supported on the floor of the heading and the roof beams 8 are pushed against the roof of the heading. The mining machine then starts to operate and moves forward with respect to the shield. Once the machine has moved a certain distance forward, one of the canopy units, for example the first canopy unit, is advanced behind the machine. This is done by retracting the rams 10 supporting the outer roof beams 8*a* 8*c* and 8*e*, so that the roof remains supported only be the beams 8*b* and 8*d*, then advancing the first canopy unit by extending the hydraulic rams 50 mounted between the first and second canopy units so that the first unit is pushed forward against the second unit which is held stationary because it is stressed against the roof of the heading. When the first unit has been fully advanced, the associated rams 10 are again extended so that the roof beams support the roof forward of the initial location. This position is shown in FIG. 3. The rams 10 associated with the second canopy unit are then retracted, and the second unit is pulled forward by the hydraulic rams 50 up to the first unit. The rams of the second unit are then again extended.

Roof bolting can obviously be carried out behind the shield. Bolts can however also be inserted between the roof beams, since it is possible for an operator to stand on either side of the conveyor and to drill holes as indicated by the dotted lines 20 in FIG. 2.

Wheels 18 can only be extended when all the rams 10 and 11 have been retracted. In this situation the rams 19 are then extended to push the wheels 18 downwards and therefore to lift the shield up. In practice, a slight pressure may be retained in the rams 19 pressing the wheels 18 downwards. This slight pressure will be easily overcome by the rams 10 when they are extended, but when one set of rams is retracted so that one of the units can be moved forward, the pressure in the appropriate ram 19 will serve to lift one end of the unit on to the wheel and therefore to facilitate movement of the pontoon bases 9 along the floor.

A heading shield of this type can be used in most situations where a continuous mining machine can be used, and can permit the continuous mining machine to develop its full potential. It would be possible to design a shield with more than two canopy units, and with corresponding numbers of roof beams.

FIGS. 5 to 10 show various different configurations of the supporting structure between the base pontoons and roof beams. In these figures, parts which correspond to parts in the preceding figures will be designated by reference numerals which are arrived at by adding 100 to the corresponding reference numerals in the previous figures.

Generally, it is important to keep the roof beams 108 parallel to the base pontoons 109 as the roof beams are raised and lowered.

Figure 5:
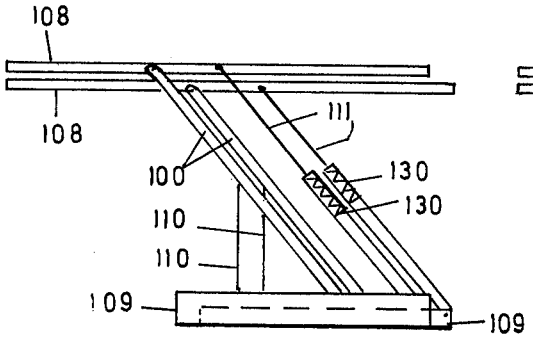
FIGS. 5 to 10 show schematically various different shield configurations according to the invention.

In FIG. 5, the roof beams 108 are connected to the base pontoons 109 by rigid pivoted links 100. Main hydraulic rams 110 act between the base pontoons 109 and central parts of the links 100 to raise and lower the roof beams 108. Stablising rams 111 are also connected between the pontoons 109 and roof beams 108, and springs 130 are included in the stabilising rams to ensure that the roof beams remain horizontal when they are lowered for advancing the shield.

Figure 6:
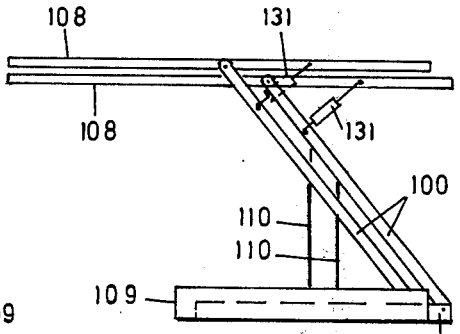

In FIG. 6, pivoted links 100 connect the base pontoons 109 and the roof beams 108 as in FIG. 5. However instead of the stailising rams 111 of FIG. 5, stiffening rams 131 are connected between the links 100 and the roof beams 108 to ensure parallelism when raising and lowering the roof beams.

Figure 7:
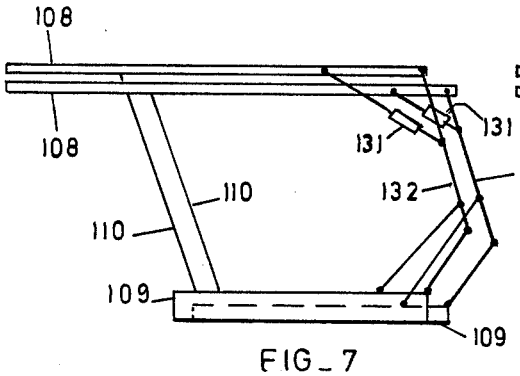

In the embodiment of FIG. 7, the rigid links 100 are replaced by systems of pivotal links indicated generally at 132. Again, stiffening rams 131 are provided between the link systems 132 and the roof beams 108.

Figure 8:
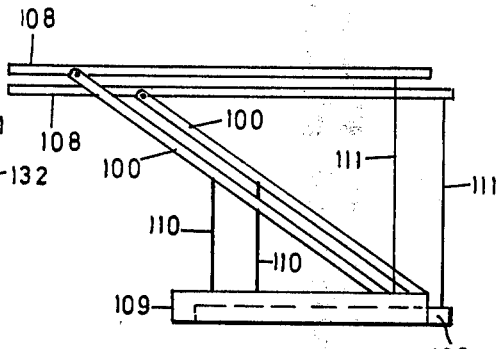

The configuration shown in FIG. 8 is similar to that in FIG. 5, with the exception that the stabilising rams 111 are arranged vertically.

Figure 9:
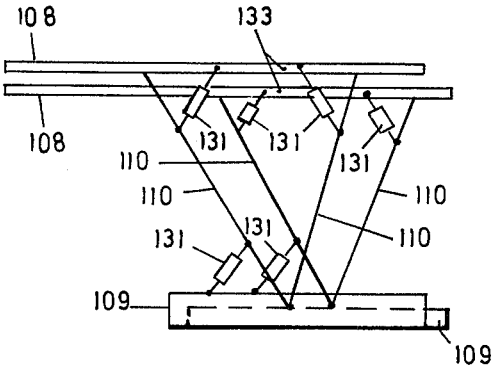

FIG. 9 shows a configuration where the roof beams 108 are made in two parts hinged together on an axis 133. This makes it possible for the roof beams to conform to an uneven roof surface. In this embodiment, a main hydraulic ram 110 is provided between the base pontoon 109 and each hinged roof beam portion.

Pivoting rams 131 control the angles of the main rams.

Figure 10:
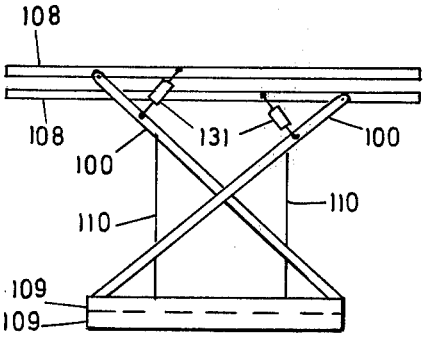

The configuration shown in FIG. 10 is the same as that shown in FIG. 6 with the exception that the links 100 are arranged in opposite positions.

We claim:

1. A mobile mine conveying and support apparatus for protecting a separate continuous mining machine and collecting material mined by said machine, said apparatus comprising:

(a) a first portable mine roof support means, said means having;
  (i) at least two longitudinal roof beams generally parallel to one another to engage the mine roof,
  (ii) at least two longitudinal base support means mounted below said roof support beams to engage the mine floor,
  (iii) at least two hydraulic pistons mounted therebetween for intermittently urging said roof beams into engagement with a mine roof, (b) a second portable mine roof support means, said means having;
  (i) at least two longitudinal roof beams generally parallel to one another to engage the mine roof adjacent the roof beams of said first support beams,
  (ii) at least two longitudinal base support means mounted below said roof support means to engage the mine floor adjacent the longitudinal base support means of the first support means,
  (iii) at least two hydraulic pistons for intermittently urging said roof beams into engagement with said roof when said roof is not supported by said first support means, (c) the innermost longitudinal base support means of said first and second support means defining therebetween an operating space for a continuous mining machine;

(d) hydraulic advancing means for linking said first and second portable roof support means to advance each of said support means when its respective roof beams are withdrawn from engagement with said mine roof;

(e) conveyor means mounted between the inner most longitudinal base support means of said first and second mine roof support means for collecting and conveying material mined by said continuous mining machine;

whereby said portable roof support means is advanced intermittently forward by said hydraulic advancing means to protect an operator of a separate continuous mining machine that is advanced forward in a continuous manner.

2. A mobile mining conveying and support apparatus as claimed in claim 1, which further comprises pivotal links between said roof beams and said longitudinal base support means, each of said hydraulic pistons being mounted by a first end on said links and by a second end on said roof beams.

3. A mobile mining conveying and support apparatus as claimed in claim 1 which further comprises pivotal links between said roof beams and said longitudinal base support means, each of said hydraulic pistons being mounted by a first end on said link, and by a second end on said longitudinal base support means.

4. A mobile mining conveying and support apparatus as claimed in claim 1 which further comprises pivotal links between said roof beams and said longitudinal base support means, each of said links having a pair of hydraulic pistons mounted thereon with first ends mounted on said links, and the second end of said first of said pair attached to said roof beam, the second end of said second of said pair being attached to said longitudinal base support means.

5. A mobile mining conveying and support apparatus as claimed in claim 1 which further comprises at least two pivotal links between a roof beam and its associated base support means.

6. A mobile mining conveying and support apparatus as claimed in claim 1 wherein said hydraulic pistons have a first end connected to a roof beam, and a second end connected to an associated base support means.

7. A mobile mining conveying and support apparatus as claimed in claim 1 which further comprises at least one additional roof beam for said first portable mine roof support means, said additional roof beams being supported by at least one cross beam extending between said two longitudinal roof beam.

8. A mobile mine conveying and support apparatus according to claim 1 provided with a bunker which spans the operating spaced defined by the base support means.

9. A mobile mine conveying and support apparatus according to claim 1, wherein at least one of the roof beams is hollow and open at the end to allow ventilating air to pass therethrough.

10. A mobile mine conveying and support apparatus according to claim 1, wherein the roof beams of one support means are positioned between the roof beams of another support means.

11. A mobile mine conveying and support apparatus according to claim 1, wherein the base support means are mounted on retractable wheels.

12. A mobile mine conveying and support apparatus according to claim 1, wherein the base support means comprises pontoons which extend along each side of the apparatus.

* * * * *